US011152734B2

(12) United States Patent
Giesbrecht

(10) Patent No.: US 11,152,734 B2
(45) Date of Patent: Oct. 19, 2021

(54) MODULAR CONTACT CARRIER FOR AN INDUSTRIAL CONNECTOR

(71) Applicant: HARTING ELECTRIC GMBH & CO. KG, Espelkamp (DE)

(72) Inventor: Peter Giesbrecht, Porta Westfalica (DE)

(73) Assignee: HARTING ELECTRIC GMBH & CO. KG

( * ) Notice: Subject to any disclaimer, the term of this patent is extended or adjusted under 35 U.S.C. 154(b) by 0 days.

(21) Appl. No.: 16/960,305

(22) PCT Filed: Mar. 19, 2019

(86) PCT No.: PCT/DE2019/100250
§ 371 (c)(1),
(2) Date: Jul. 6, 2020

(87) PCT Pub. No.: WO2019/179572
PCT Pub. Date: Sep. 26, 2019

(65) Prior Publication Data

US 2021/0013664 A1 Jan. 14, 2021

(30) Foreign Application Priority Data

Mar. 22, 2018 (DE) ..... 10 2018 106 880.8

(51) Int. Cl.
*H01R 13/426* (2006.01)
*H01R 13/424* (2006.01)
*H01R 13/506* (2006.01)

(52) U.S. Cl.
CPC ..... *H01R 13/426* (2013.01); *H01R 13/424* (2013.01); *H01R 13/506* (2013.01)

(58) Field of Classification Search
CPC ..... H01R 13/40; H01R 13/42; H01R 13/422; H01R 13/424; H01R 13/426; H01R 13/506
See application file for complete search history.

(56) References Cited

U.S. PATENT DOCUMENTS 4,017,141 A 4/1977 Bury et al. ..... 339/217 S
4,443,048 A * 4/1984 Moist, Jr. ..... H01R 43/20 439/599

(Continued)

FOREIGN PATENT DOCUMENTS

DE 2 424 898 12/1974 ..... H01R 13/40
DE 10 2013 019 695 5/2015 ..... H01R 13/436

(Continued)

OTHER PUBLICATIONS

German Search Report issued in German Patent Appln. 10 2018 106 880.0, dated Dec. 20, 2018, with English translation, 17 pages.

(Continued)

*Primary Examiner* — Oscar C Jimenez
(74) *Attorney, Agent, or Firm* — Hayes Soloway P.C.

(57) ABSTRACT

Disclosed is a contact carrier for an industrial connector, wherein the contact carrier has a main body, a plurality of contact elements and at least one fixing element, wherein a plurality of recesses are provided in the main body of the contact carrier, in which the contact elements are arranged, wherein the contact elements are fixed in the main body via the fixing elements secured reversibly to the main body.

17 Claims, 2 Drawing Sheets

(56) References Cited

U.S. PATENT DOCUMENTS

Figure 1:
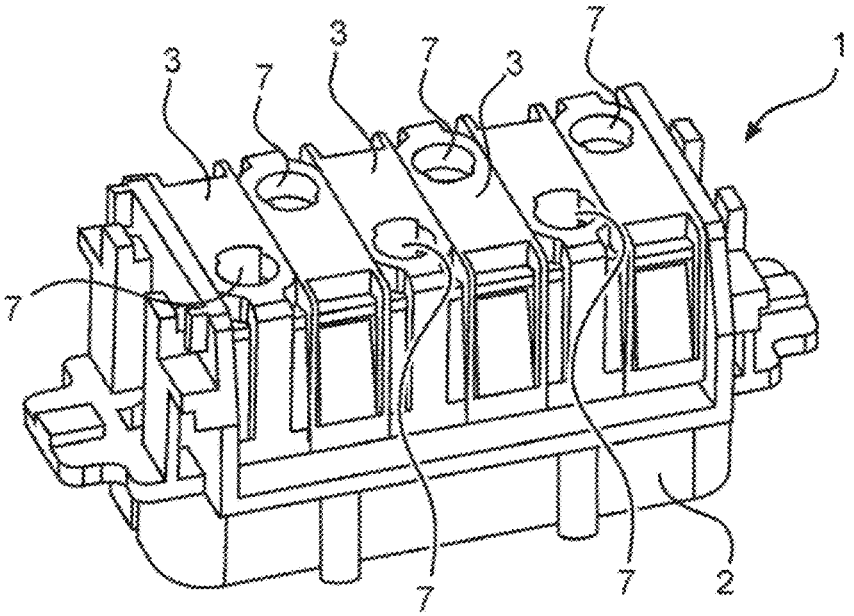

| | | | | | |
|---|---|---|---|---|---|
| 4,544,220 | A * | 10/1985 | Aiello | H01R 13/424 | 439/594 |
| 4,946,398 | A * | 8/1990 | Takenouchi | H01R 13/4368 | 439/595 |
| 5,059,142 | A * | 10/1991 | Ohta | H01R 13/4368 | 439/752 |
| 5,061,210 | A * | 10/1991 | Jinno | H01R 13/4368 | 439/752 |
| 5,439,397 | A * | 8/1995 | Yamanashi | H01R 13/4368 | 439/752 |
| 5,575,692 | A * | 11/1996 | Cecil, Jr. | H01R 13/4368 | 439/752 |
| 5,611,712 | A * | 3/1997 | Morishita | H01R 13/4367 | 439/752 |
| 5,713,760 | A * | 2/1998 | Chemin | H01R 13/4365 | 439/595 |
| 7,029,328 | B1 * | 4/2006 | Mckenzie | H01R 13/5221 | 439/587 |
| 9,761,982 | B2 | 9/2017 | Bertsch | H01R 13/426 | |
| 9,865,958 | B2 | 1/2018 | Beischer | H01R 13/512 | |
| 10,665,982 | B2 * | 5/2020 | Herbrechtsmeier | H01R 43/20 | |

FOREIGN PATENT DOCUMENTS

| | | | |
|---|---|---|---|
| DE | 10 2014 109 351 | 7/2015 | H01R 13/655 |
| EP | 0 591 950 | 4/1994 | H01R 13/436 |
| EP | 2 280 456 | 2/2011 | H01R 13/506 |
| WO | WO 88/07775 | 10/1988 | H01R 13/436 |

OTHER PUBLICATIONS

International Search Report (with English translation) and Written Opinion issued in PCT/DE2019/100250, dated Jun. 13, 2019, 11 pages.

International Preliminary Report on Patentability issued in PCT/DE2019/100250, dated Sep. 22, 2020, 7 pages.

* cited by examiner

MODULAR CONTACT CARRIER FOR AN INDUSTRIAL CONNECTOR

The invention is based on a contact carrier for industrial connectors.

Such a contact carrier may be used in so-called industrial connectors that are described by way of example also as rectangular connectors and/or as heavy duty connectors. Connectors of this type and mating connectors are used in order to produce an electrical and mechanical connection between two electrical lines or an electrical line and a device or an installation in the industrial field. In particular for the transmission of high currents, these aforementioned connectors are required that are protected by their generally metal housing also in particular well protected against diverse environmental influences, such as for example dust, contamination, moisture, temperature and also for shielding electrical and/or magnetic fields.

The connector housings used are usually embodied from aluminum and are provided on the cable connection-side with a thread for receiving a cable screw connection. The connectors being considered in this case are configured so as to connect a plurality of electrical conductors of which one is a protective conductor (PE contact). The protective conductor may also be configured combined with a neutral conductor as a PEN contact. The protective conductor is connected to the protective conductor bridge in order to render possible an appropriate protective conductor function and to bring the protective conductors of connectors and mating connectors into contact with one another. The other conductors are connected to the electrical contact elements of the plug inserts.

The principle construction of the connector and of the mating connector may be essentially identical and differ only in the configuration of their electrical contact elements for producing the electrical connection. The statements regarding the connector consequently accordingly apply for the mating connector.

PRIOR ART

DE 10 2014 109 351 B3 discloses a contact carrier for an industrial connector. The contact carrier comprises a so-called PE contact that is electrically connected to a protective conductor bridge.

The contact carrier is equipped with electrical contact elements. However, it is also possible to use pneumatic contact elements and/or optical contact elements as contact elements. The contact carriers are pre-mounted. It is necessary to design different contact carriers for the respective application field. As a result, a multiplicity of different contact carriers exists that necessitates a manufacturer to have a certain amount of storage space.

During the priority application regarding the current application, the German Patent and Trademark Office has researched the following prior art:

DE 10 2014 109 351 B3; DE 10 2013 019 695 A1 and DE 24 24 898 A.

OBJECT OF THE INVENTION

The object of the invention is to simplify the production procedure of a contact carrier.

The contact carrier in accordance with the invention is intended in particular for use in an industrial connector. The contact carrier comprises attachment means that are used to attach it in a connector housing. Generally, the attachment arrangement is provided via a screw connection.

The principle construction of the cable connection region of the respective insulating body of the connector and of the mating connector may be essentially identical. The two insulating bodies may differ merely in the configuration of their plugging regions. The following statements regarding the connector consequently accordingly apply for the mating connector.

The contact carrier comprises a base body, a plurality of contact elements and at least one fixing element. The base body of the contact carrier is provided with a plurality of receiving devices in which the contact elements are arranged. The contact elements are fixed in the receiving devices via the fixing elements that are attached to the base body. The fixing elements may be reversibly fixed to the base body. As a consequence, the base body may be re-used if it is necessary to use other contact elements. However, it may also be expedient not to use a reversible fixing arrangement so that a customer is unable to manipulate the connector.

The number of receiving devices in the base body may be greater than the number of contact elements. It is not necessary to equip all the receiving devices of the base body with a contact element. Also the type of contact elements may differ. As a consequence, it is possible to use a base body for multiple variants of a contact carrier.

In one advantageous embodiment of the invention, the base body comprises multiple receiving regions that are arranged adjacent to one another. The individual receiving regions each comprise at least one receiving device for contact elements. It is also possible to provide multiple receiving devices for contact elements in one receiving region, In one embodiment of the invention, an individual fixing element may cover the entire base body. Depending upon the number of contact elements, this fixing element is provided with the appropriate number of openings that align with the receiving devices in which a contact element is provided.

In one development of the invention, a fixing element is allocated to each receiving region. The fixing element comprises at least one opening that aligns with a receiving device for a contact element in the base body. Alternatively, the fixing element comprises at least two openings that align in each case with a receiving device for a contact element in the base body. In this case, 'align' means that the openings are arranged directly over the receiving devices. The main axis of symmetry of the essentially cylindrical receiving device passes through the middle point of the essentially circular opening. A conductor of a cable may pass through the opening of the fixing element into the receiving device of the contact element and thus produce a contacting arrangement between the conductor and the contact element. For this purpose, the contact element may comprise for example a screw connection. One receiving region is covered in each case by one fixing element. In the case of this embodiment of the invention, the number of fixing elements corresponds to the number of receiving regions.

In one development of the invention the fixing element comprises at least one clamping arm for fixing a contact element in the base body. In this case, the clamping arm engages in the respective receiving device of the base body and fixes the contact element that is located therein. The clamping arm is oriented essentially parallel to the plugging direction of the contact carrier. The clamping arm that is located in the receiving device engages at a side with the contact element and thus clamps said contact element in the receiving device. The contact element is held in the receiving device by means of the clamping arm but still has a certain amount of play in order to compensate plugging inaccuracies during the plugging procedure with a contact element of a mating connector.

It is preferred that the fixing element comprises two attachment arms for fixing the fixing element to the base body. The attachment arms engage in each case at a side with the base body of the contact carrier. As a consequence, the fixing element is reversibly fixed to the base body.

In a preferred embodiment of the invention, a first attachment arm comprises a tab that engages in an undercut in the base body. The other (second) attachment arm comprises two inward facing connecting pieces that engage in each case in an undercut in the base body. As a consequence, the fixing element may be fixed to the base body in a reversible manner and without the need for a tool.

The fixing elements are embodied from synthetic material and may be manufactured in a cost-effective manner using an injection molding method. The base body is likewise embodied from a synthetic material. The materials of the base body and of the fixing element may be different.

EXEMPLARY EMBODIMENT

Figure 2:
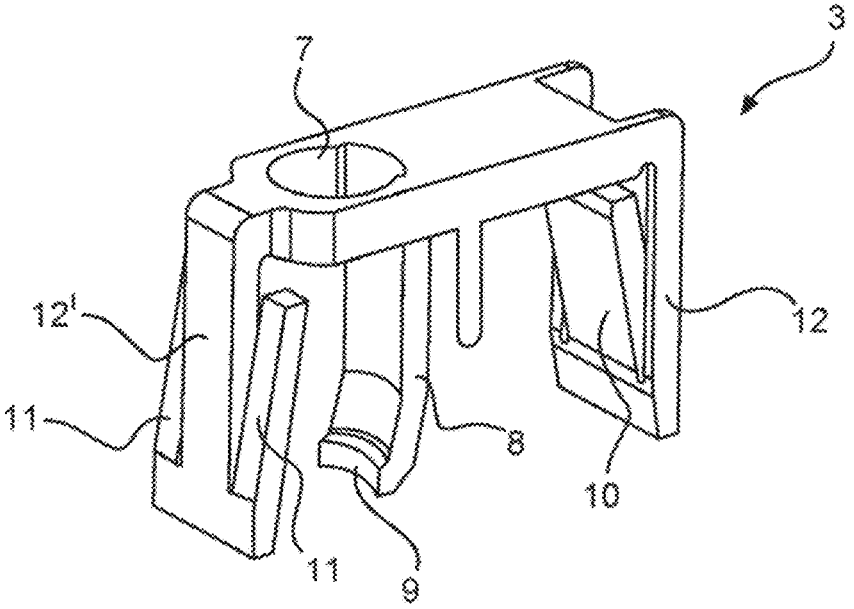
Figure 3:
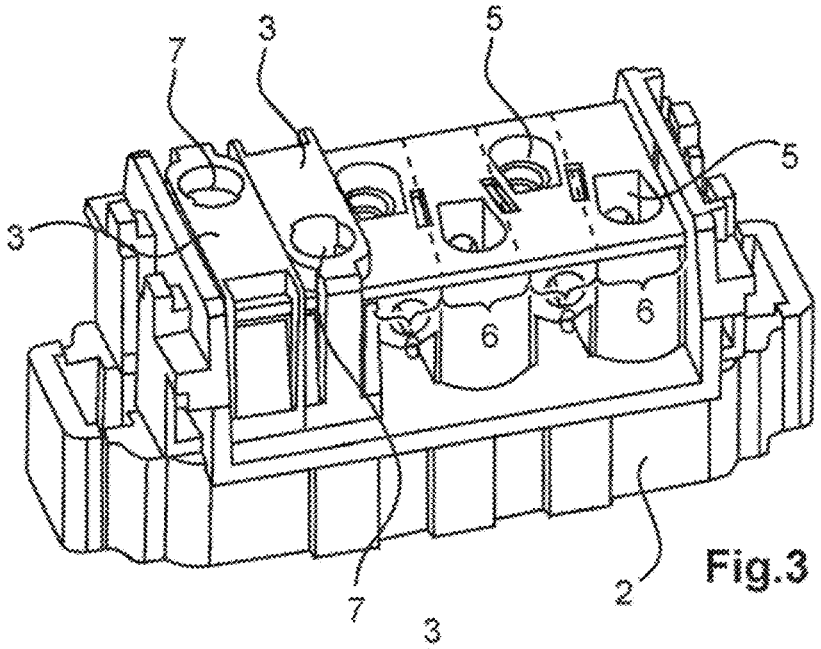
Figure 4:
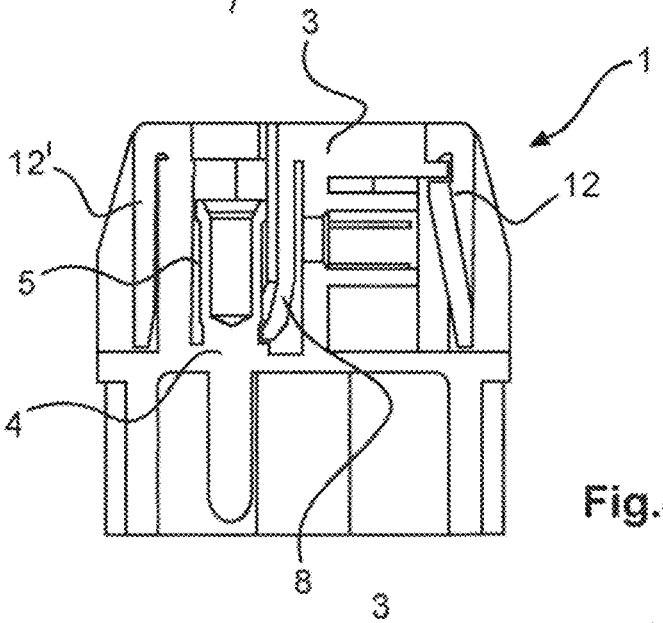
Figure 5:
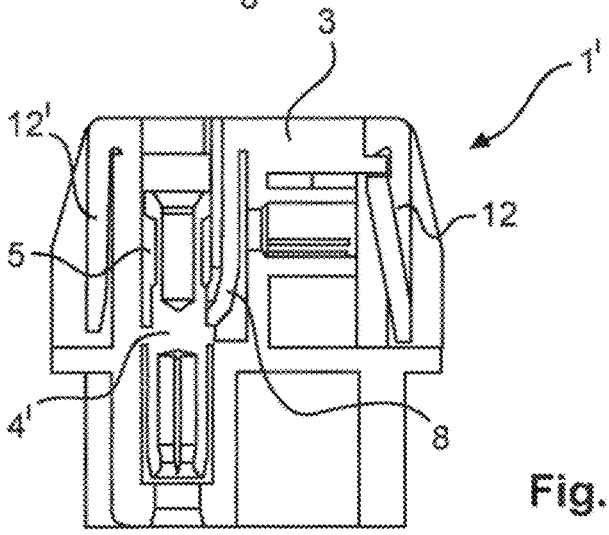

An exemplary embodiment of the invention is illustrated in the drawings and is explained in detail below. In the drawings:

FIG. 1 Illustrates a perspective view of a contact carrier in accordance with the invention, FIG. 2 Illustrates a perspective view of a fixing element in accordance with the invention, FIG. 3 Illustrates a perspective view of a base body with two fixing elements, FIG. 4 Illustrates a sectional view of the contact carrier with integrated contact pins and FIG. 5 Illustrates a sectional view of the contact carrier with integrated contact bushes.

The figures illustrate in part simplified schematic views. In part, identical reference numerals are used for similar but possibly not identical elements. Different views of similar elements may be scaled differently.

FIG. 1 illustrates a contact carrier 1 as is used in the case of industrial connectors (not illustrated). The contact carrier 1 is attached for this purpose in a connector housing (not illustrated). The contact carrier 1 comprises a base body 2, a plurality of contact elements 4, 4' (see FIGS. 4 and 5) and at least one fixing element 3. The base body 2 of the contact carrier 1 is provided with a plurality of receiving devices 5 in which the contact elements 4, 4' are arranged. The base body 2 has an essentially cuboid shape. The contact elements 4, 4' are fixed in the base body via the fixing elements 3 that are attached in a reversible manner to the base body 2.

It is apparent in FIG. 3 that the base body 2 comprises multiple receiving regions 6 that are arranged adjacent to one another and in which is provided in each case at least one receiving device 5 for a contact element 4, 4'. Each receiving region 6 is allocated a fixing element 3.

FIG. 2 illustrates such a fixing element 3 in a perspective view. The fixing element 3 comprises at least one opening 7 that aligns with a receiving device 5 for a contact element 4, 4' in the base body 2. The opening 7 of the fixing element 3 is in each case precisely above the plug-side opening that forms the receiving device 5 of the contact element 4, 4'. A conductor of a cable (not illustrated) may engage with or grip the contact element 4, 4' via the opening 7 of the fixing element 3 (or vice versa).

The fixing element 3 has essentially a U-shape. The fixing element 3 comprises a clamping arm 8 between two side attachment arms 12, 12' for fixing a contact element 4, 4' in the base body 2. It is apparent in FIGS. 4 and 5 that the contact element 4, 4' is held or fixed in the receiving device 5 with the aid of the clamping arm 8. In so doing, the lower end 9 of the clamping 8 contacts the cylindrical contact element 4, 4' in a positive-locking manner whereby the contact element 4, 4' is held or fixed in the receiving device 5.

The fixing element 3 comprises two attachment arms 12, 12' for fixing the fixing element 3 to the base body 2. The attachment arms 12, 12' engage in each case at a side with the base body 2, whereby the fixing element 3 is reversibly fixed to the base body 2. The attachment arms 12, 12' have essentially the same function but are configured structurally different. A first attachment arm 12 comprises an inward facing tab 10 that engages in an undercut in the base body 2. The second attachment arm 12' comprises two inward facing connecting pieces 11 that engage in each case in an undercut in the base body 2.

FIGS. 4 and 5 illustrate sectional views of the contact carrier 1, 1' in accordance with the invention. FIG. 4 illustrates a contact carrier 1 with a contact element 4 that is configured as a contact pin. FIG. 5 illustrates a contact carrier 1' with a contact element 4' that is configured as a contact bush. The contact carriers 1, 1' illustrated here are configured for a connector and for a matching mating connector.

The base body 2 may be equipped with similar and/or different contact elements of any type (electrical, pneumatic, optical etc.). Said contact elements may be fixed in the base body 2 via the fixing elements 3. As a consequence, contact carriers 1, 1' may be manufactured effectively and using few different components.

Even if different aspects or features of the invention are illustrated in the figures in each case in combination, it is obvious to the person skilled in the art—unless otherwise indicated—that the illustrated and discussed combinations are not the only possibilities. In particular, units or feature complexes of different exemplary embodiments that correspond to one another may be exchanged with one another.

Modular Contact Carrier for an Industrial Connector

LIST OF REFERENCE NUMERALS

1 Contact carrier
2 Base body
3 Fixing element
4 Contact element
5 Receiving device for a contact element
6 Receiving region
7 Opening
8 Clamping arm
9 Lower end of the clamping arm
10 Tab
11 Connecting piece

The invention claimed is:

1. A contact carrier for an industrial connector, wherein the contact carrier comprises a base body, a plurality of contact elements and at least one fixing element, wherein the base body of the contact carrier is provided with a plurality of receiving devices in which the contact elements are arranged, and wherein the contact elements are fixed in the base body via the fixing elements that are attached to the base body, wherein the fixing element comprises first and second attachment arms for fixing the fixing element to the base body, wherein the first and second attachment arms are configured structurally different from one another; wherein the attachment arms engage in each case at a side with the base body and as a consequence fix the fixing element to the base body, the first attachment arm comprises a tab that engages with an undercut in the base body, and the second attachment arm comprises two inward facing connecting pieces that engage in each case in an undercut in the base body.

2. The contact carrier as claimed in claim 1 wherein the base body comprises multiple receiving regions that are arranged adjacent to one another and in which is provided in each case at least one receiving device for a contact element.

3. The contact carrier as claimed in claim 2, wherein each receiving region is allocated a fixing element.

4. The contact carrier as claimed in claim 3, wherein the fixing element comprises at least one opening that aligns with a receiving device for a contact element in the base body.

5. The contact carrier as claimed in claim 3, wherein the fixing element comprises two openings that align in each case with a receiving device for a contact element in the base body.

6. The contact carrier as claimed in claim 3, wherein in each case a fixing element covers a receiving region.

7. The contact carrier as claimed in claim 3, wherein the fixing element comprises at least one clamping arm for fixing a contact element in the base body.

8. The contact carrier as claimed in claim 2, wherein in each case a fixing element covers a receiving region.

9. The contact carrier as claimed in claim 2, wherein the fixing element comprises at least one opening that aligns with a receiving device for a contact element in the base body.

10. The contact carrier as claimed in claim 2, wherein the fixing element comprises two openings that align in each case with a receiving device for a contact element in the base body.

11. The contact carrier as claimed in claim 2, wherein the fixing element comprises at least one clamping arm for fixing a contact element in the base body.

12. The contact carrier as claimed in claim 1, wherein the fixing element comprises at least one opening that aligns with a receiving device for a contact element in the base body.

13. The contact carrier as claimed in claim 12, wherein in each case a fixing element covers a receiving region.

14. The contact carrier as claimed in claim 1, wherein the fixing element comprises two openings that align in each case with a receiving device for a contact element in the base body.

15. The contact carrier as claimed in claim 14, wherein in each case a fixing element covers a receiving region.

16. The contact carrier as claimed in claim 1, wherein the fixing element comprises at least one clamping arm for fixing a contact element in the base body.

17. The contact carrier as claimed in claim 16, wherein the clamping arm engages in the respective receiving device of the base body and fixes the contact element that is located therein.

* * * * *